US007320358B2

(12) United States Patent
Kaspar et al.

(10) Patent No.: US 7,320,358 B2
(45) **Date of Patent: *Jan. 22, 2008**

(54) RIBBED MOUNTING BRACKET FOR HEAT EXCHANGERS

(75) Inventors: Asad Max Kaspar, Fergus (CA); Silvio Tonellato, Mississauga (CA)

(73) Assignee: Dana Canada Corporation, Oakville, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/851,784

(22) Filed: May 21, 2004

(65) Prior Publication Data

US 2005/0006544 A1 Jan. 13, 2005

(30) Foreign Application Priority Data

Jun. 27, 2003 (CA) ..... 2433975

(51) Int. Cl.
*F28F 9/00* (2006.01)

(52) U.S. Cl. ..... 165/67; 165/166; 165/167; 248/232

(58) Field of Classification Search ..... 248/300, 248/200, 213.3, 230.7, 230.6, 232; 165/166, 165/167, 67, 68, 76, 149, 153, 152, 140, 165/170, 175

See application file for complete search history.

(56) References Cited

U.S. PATENT DOCUMENTS

| | | | |
|---|---|---|---|
| 1,246,325 | A | 11/1917 | Rohmer |
| 4,258,785 | A | 3/1981 | Beldam |
| 4,569,390 | A | 2/1986 | Knowlton et al. |
| 5,058,662 | A | 10/1991 | Nguyen |
| 5,069,275 | A | 12/1991 | Suzuki et al. |
| 5,086,832 | A | 2/1992 | Kadle et al. |
| 5,107,926 | A | 4/1992 | Calleson |
| 5,183,103 | A | 2/1993 | Tokutake |
| 5,205,349 | A | 4/1993 | Nagao et al. |
| 5,407,161 | A | 4/1995 | Mulkeran |
| 5,429,182 | A | 7/1995 | Hanafusa |
| 5,487,422 | A | 1/1996 | Bertva et al. |
| 5,535,819 | A | 7/1996 | Matsuura |
| 5,570,737 | A | 11/1996 | Tokutake |
| 5,692,559 | A | 12/1997 | Cheong |
| 5,720,341 | A | 2/1998 | Watanabe et al. |
| 5,791,402 | A | 8/1998 | Dumetz |
| 5,899,263 | A | 5/1999 | Tokutake |
| 5,947,196 | A | 9/1999 | Halm et al. |
| 5,964,282 | A | 10/1999 | Seiler et al. |

(Continued)

FOREIGN PATENT DOCUMENTS

| | | |
|---|---|---|
| CA | 2405275 | 3/2003 |

(Continued)

*Primary Examiner*—Kimberly Wood
(74) *Attorney, Agent, or Firm*—Ridout & Maybee LLP

(57) ABSTRACT

A mounting bracket is shown for use with a heat exchanger core including spaced-apart tubes having peripheral flanges surrounding a manifold. The bracket has a clip and a pair of bearing portions. The clip has a groove adapted to engage the front edge of a selected flange. The bearing portions are connected to the clip and positioned to engage, respectively, the back edge portions of adjacent flanges disposed above and below the selected flange, thereby to grip the core by the tube peripheral flanges. A panel portion is connected to the clip for mounting the heat exchanger core.

20 Claims, 8 Drawing Sheets

U.S. PATENT DOCUMENTS

| | | | | |
|---|---|---|---|---|
| 6,263,954 | B1 | 7/2001 | Nakayama | |
| 6,405,788 | B1 | 6/2002 | Balthazard | |
| 6,530,424 | B2 | 3/2003 | Jamison et al. | |
| 6,742,572 | B2 * | 6/2004 | Muhammad et al. | 165/67 |
| 2003/0146030 | A1 | 8/2003 | Harada | |
| 2004/0261973 | A1 * | 12/2004 | Kent et al. | 165/67 |

FOREIGN PATENT DOCUMENTS

| | | |
|---|---|---|
| CA | 2069783 | 10/2003 |
| DE | 3215 961 | 11/1983 |
| DE | 4232019 | 10/1993 |
| EP | 1496270 | 1/2005 |
| FR | 2527325 | 11/1983 |
| FR | 2550618 | 2/1985 |
| FR | 2748559 | 11/1997 |
| JP | 3-164694 | 7/1991 |
| JP | 4288484 | 10/1992 |
| JP | 04288486 | 10/1992 |
| JP | 08159686 | 6/1996 |
| JP | 2002168589 | 6/2002 |

* cited by examiner 20
68

70A
70A
74
58
72
70
60

72
62
64
66
72
70
70
58

58
74
74
72
72
70
60
70

70A
70A
58
68
60
74
72
70

58
74
74
60
70
70
72
72

68A
62
64
66
72
72
68B

RIBBED MOUNTING BRACKET FOR HEAT EXCHANGERS

This application claims priority from Canadian Patent application No. 2,433,975 filed Jun. 27, 2003.

FIELD OF THE INVENTION

The present invention relates to the field of heat exchangers, and more particularly, to mounting brackets for heat exchanger cores.

BACKGROUND OF THE INVENTION

Heat exchanger cores are commonly formed from a plurality of thin, substantially flat tubes, stacked upon one another in spaced relation, which extend between a pair of spaced-apart manifolds. The manifolds are often simply constructed from pipe, suitably perforated to receive the flat tubes. Exemplary of this construction is the heat exchanger described in U.S. Pat. No. 5,183,103 (Tokutake), issued Feb. 2, 1993.

In the above-mentioned pipe manifold type heat exchangers, it is known to braze mounting brackets to the manifold for the purpose of mounting them within an engine compartment of a vehicle or the like. The mounting bracket usually includes a tab or flange adapted to be secured to the vehicle frame. Usually, the mounting bracket is provided with a portion which is capable of resiliently engaging the exterior of the manifold to keep the mounting bracket in place during the brazing process, so as to avoid the need for auxiliary clamping tools, which can add to cost and can absorb heat in a brazing oven, resulting in poor quality brazed joints. The mounting brackets taught in U.S. Pat. No. 5,069,275 (Suzuki et al.), issued Dec. 3, 1991, are exemplary of this construction.

A difficulty with the pipe manifold type of heat exchanger cores, however, is that the pipe manifolds have to be made quite strong to support the mounting brackets, so this makes them heavy and expensive to manufacture.

Another type of heat exchanger core made in the past uses plate pairs to define the heat exchanger passages. The plates are formed of back-to-back, dish-shaped plates, each plate having a central portion, a pair of spaced-apart bosses and a peripheral flange. The plates thus disposed in pairs have the peripheral flanges of each plate in the pair connected to one another to form a fluid passage between the central portions, and the plate pairs are disposed in stacked relation, with the bosses in adjacent pairs having through holes therein, so that when the bosses are joined to one another, they form a manifold to permit the flow of fluid through the pairs. Exemplary of this construction is the heat exchanger core described in U.S. Pat. No. 5,964,282 (Seiler et al.), issued Oct. 12, 1999.

A characteristic of the plate pair type of heat exchanger cores used in the past is that special heavier gauge plates are usually required to be joined to the fluid carrying plate pairs in order to permit suitable mounting brackets to be attached to the cores. This again increases the number of components required and thus the cost of the heat exchangers.

SUMMARY OF THE INVENTION

In the present invention, a mounting bracket is provided for a heat exchanger core having tubular or plate pair heat exchanger passages, where the tubes or plate pairs have peripheral edges or flanges adjacent to spaced-apart manifolds. The mounting bracket attaches directly to the peripheral edges or flanges, giving maximum flexibility as to the location of the mounting brackets.

According to the invention, there is provided a mounting bracket for a heat exchanger core of the type having a manifold disposed about a primary axis. The manifold is formed with a plurality of tubular manifold segments and has top and bottom ends spaced apart in the direction of a primary axis. Inner and outer sides of the manifold are spaced apart in the direction of a secondary axis perpendicular to the primary axis. Front and back sides of the manifold are spaced apart in the direction of a tertiary axis perpendicular to the primary and secondary axes. A plurality of fluid tubes are arranged in substantially parallel relation. Each tube extends inwardly from a respective manifold segment and extends therefrom substantially parallel to the secondary axis. Each tube has a respective peripheral flange with front and rear portions adjacent to the respective front and back sides of each respective manifold segment. Each flange has a pair of laterally extending front and back edge portions spaced-apart from one another in the direction of the tertiary axis.

The mounting bracket comprises a clip portion having an elongate groove formed therein which is adapted to mechanically engage the front edge portion of a selected one of the tube flanges.

A pair of bearing portions are rigidly connected to the clip portion and positioned relative thereto such that, when the selected flange is positioned to be mechanically engaged by the elongate groove, the bearing portions are adapted to engage, respectively, the back edge portion of an other of the flanges disposed above the selected flange, and against the back edge portion of a further one of the flanges disposed below the selected flange, thereby to grip the core in combination with the clip portion.

Preferably, the other flange is longitudinally adjacent to the selected flange and the further flange is longitudinally adjacent to the selected flange.

The clip portion is preferably corrugated to form three elongate, parallel furrows, the innermost of these furrows defining the elongate groove.

Preferably, the mounting bracket further comprises a mounting panel portion rigidly connected to the clip portion and adapted to be secured to a vehicle frame, in use.

In one preferred embodiment, the mounting panel portion projects laterally beyond the outer edge of the selected flange in use.

The clip portion and the panel portion preferably together define an elongate bridge structure, with each forming one end thereof, and the elongate groove runs longitudinally relative to the bridge structure and terminates at the end defined by the clip portion.

The pair of bearing portions are preferably rigidly connected to the clip portion by a pair of legs disposed in spaced-apart relation to one another, and each leg rigidly extends between the bridge structure and a respective bearing portion.

The legs are preferably substantially planar, are orientated substantially parallel to one another, and have contacting portions which are disposed, in use, in overlapping relation, respectively, against the bottom or top surface of the other flange and against the top or bottom surface of the further flange.

The legs preferably extend substantially the length of the bridge structure and the contacting portions are defined by bifurcated ends of the legs, contiguous with the clip portion, which, in use, straddle the manifold on its front, back and outer sides.

Preferably, each bearing portion comprises a transverse flange formed at the base of its respective leg, said flanges extend away from one another and are in substantially coplanar relation to one another.

The mounting bracket preferably further includes a pair of abutment ear portions each associated with a respective one of the legs, said pair of abutment ear portions extending away from one another, in substantially transverse relation to the legs, and engaging, in use, respectively, the outer edges of each of the other flange and the further flange.

Advantages, features and characteristics of the present invention, as well as methods of operation and functions of the related elements of the structure, and the combination of parts and economies of manufacture, will become apparent upon consideration of the following detailed description with reference to the accompanying drawings, the latter of which are briefly described hereinafter.

BRIEF DESCRIPTION OF THE DRAWINGS

In the accompanying drawings, which are for the purpose of illustration and description only, and are not intended as a definition of the limits of the invention.

DESCRIPTION OF A PREFERRED EMBODIMENT

Figures 1, 2, 3, 4, 5, 6, 7:
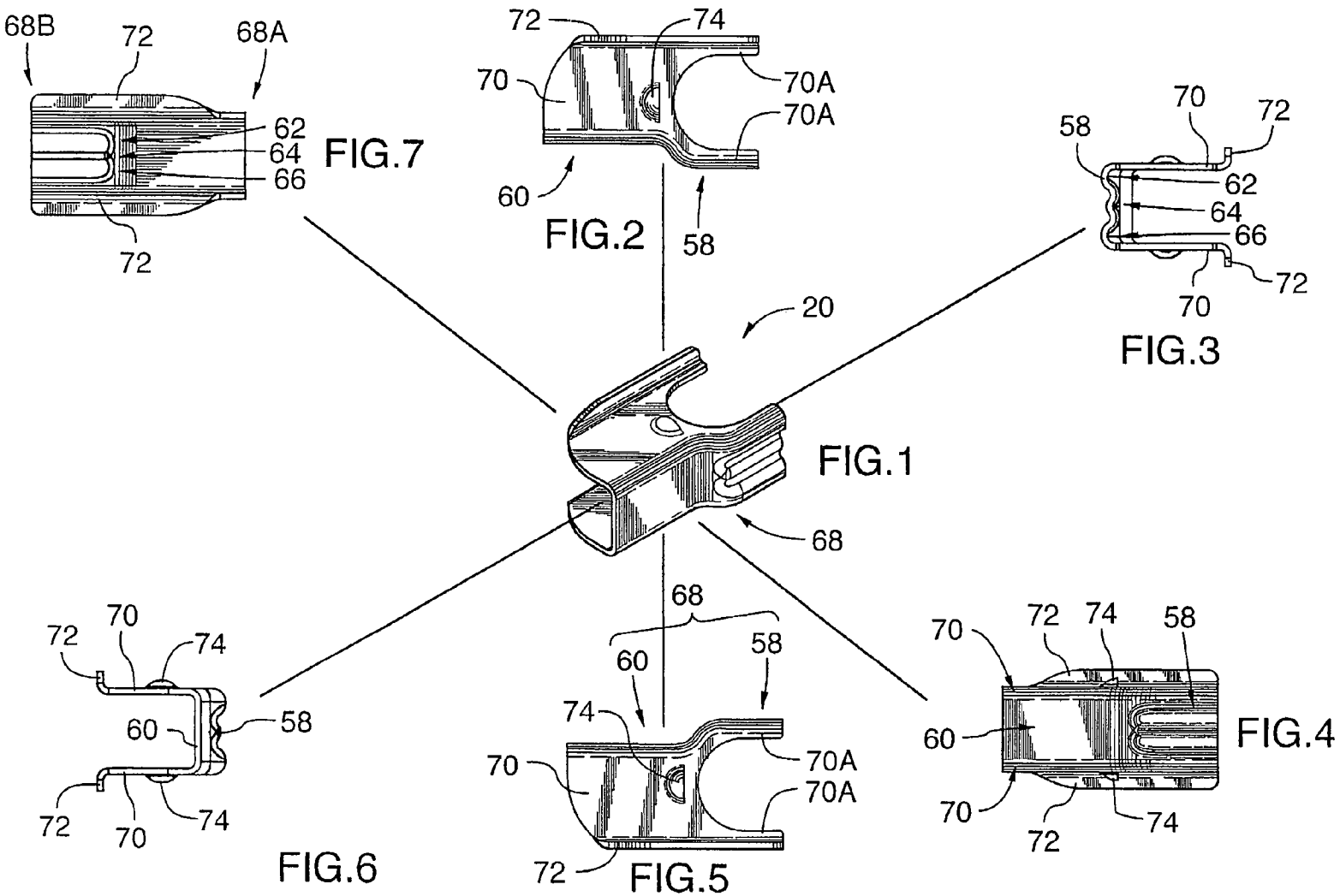
FIG. 1 is a perspective view of a mounting bracket according to a preferred embodiment of the present invention.
FIG. 2 is a top plan view of the mounting bracket of FIG. 1.
FIG. 3 is a right side elevational view of the mounting bracket of FIG. 1.
FIG. 4 is a front elevational view of the mounting bracket of FIG. 1.
FIG. 5 is a bottom view of the mounting bracket of FIG. 1.
FIG. 6 is a left side elevational view of the mounting bracket of FIG. 1.
FIG. 7 is a rear elevational view of the mounting bracket of FIG. 1.
Figure 8:
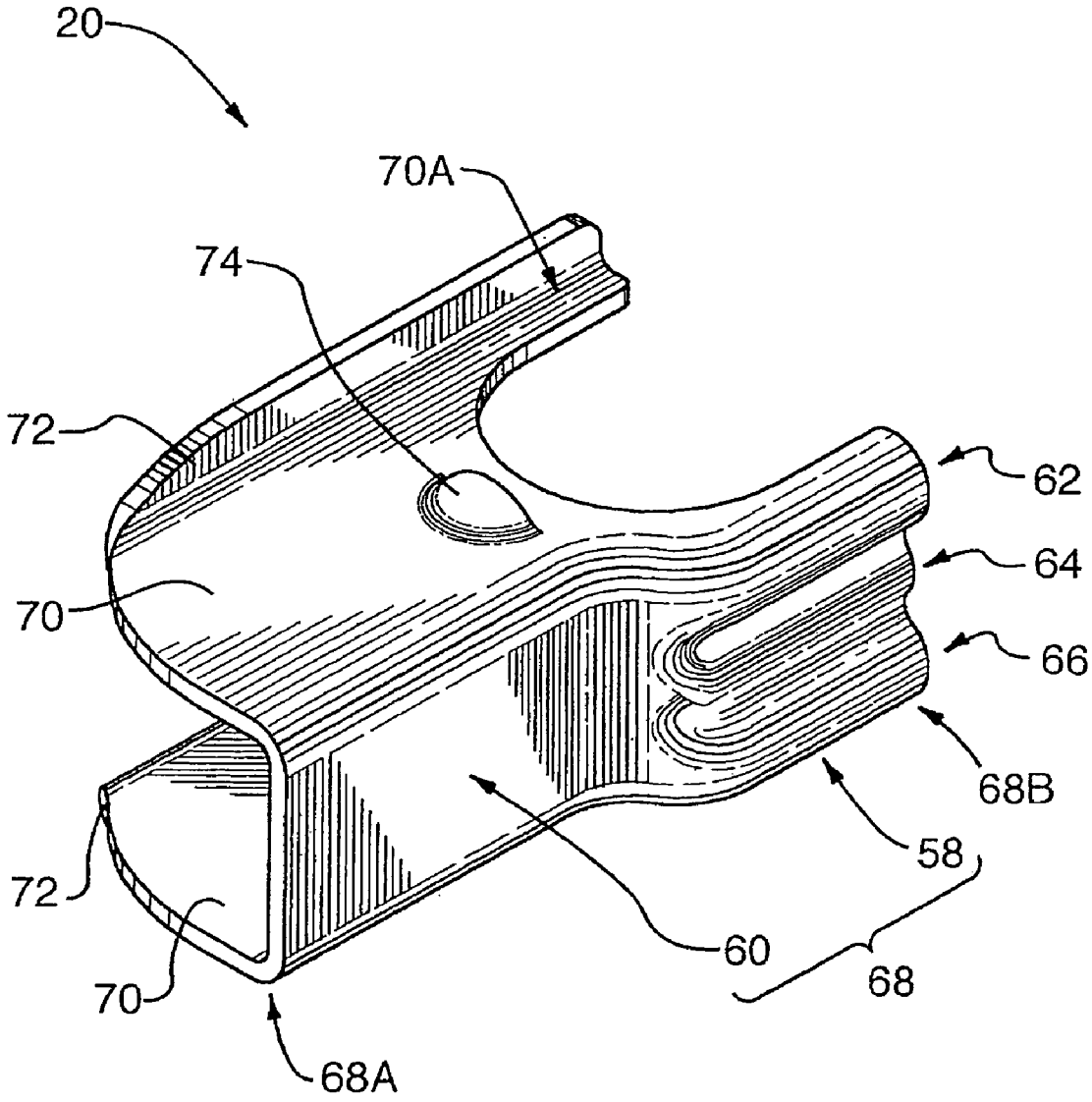
FIG. 8 is an enlarged view of the mounting bracket of FIG. 1.

A mounting bracket according to a preferred embodiment of the present invention is illustrated, inter alia, in FIG. 1 through FIG. 8, and is designated with general reference numeral 20.

The mounting bracket 20 will be described with particularity in following paragraphs.

However, for greater clarity in the following description, a heat exchanger core, which does not form part of the invention, but rather, is for use with the mounting bracket 20, will be firstly described with general reference to FIG. 9, wherein it is designated with general reference numeral 22.

In this regard, the heat exchanger core 22, only a part of which is shown for ease of illustration, includes a manifold 24 having a primary axis X-X.

The primary axis X-X is a longitudinal axis for manifold 24. Core 22 also has a secondary or lateral axis Y-Y arranged substantially transverse to the primary axis X-X to intersect same. A plurality of fluid tubes 26 extend parallel to lateral axis Y-Y. Tubes 26 are formed of plate pairs and thus have joined peripheral flanges 28.

Core 22 also has a tertiary axis Z-Z arranged substantially transverse to and intersecting each of the primary and secondary axes X-X and Y-Y.

The manifold 24 is formed by mating, communicating end bosses formed in the plate pairs, and thus is generally tubular in configuration having front side 44 and a back side 46 and an inner side 40 and an outer side 42. The outer surface 34 can be considered as having a plurality of grooves 36 formed therein between the joined peripheral flanges of the plate pairs. The grooves 36 are substantially uniformly longitudinally spaced-apart from one another and each is concentric with the primary axis X-X. The manifold 24 is thus divided into a plurality of tubular manifold segments or areas 38. The top and bottom ends 30, 32 of manifold 24 are spaced apart from one another in the direction of the primary axis X-X. The front and back manifold sides 44, 46 are spaced apart from one another in the direction of the tertiary axis Z-Z. The inner and outer manifold sides 40, 42 are spaced apart from one another in the direction of the secondary axis Y-Y.

The plurality of fluid tubes 26 are arranged in substantially parallel, spaced-apart relation. Each tube 26 is associated with a respective manifold segment 38 and extends inwardly from the inner side 40 of one manifold 24 to another manifold 24 (not shown) at the opposite end of heat exchanger core 22. The tubes 26 are substantially parallel to the secondary axis Y-Y.

Figure 9:
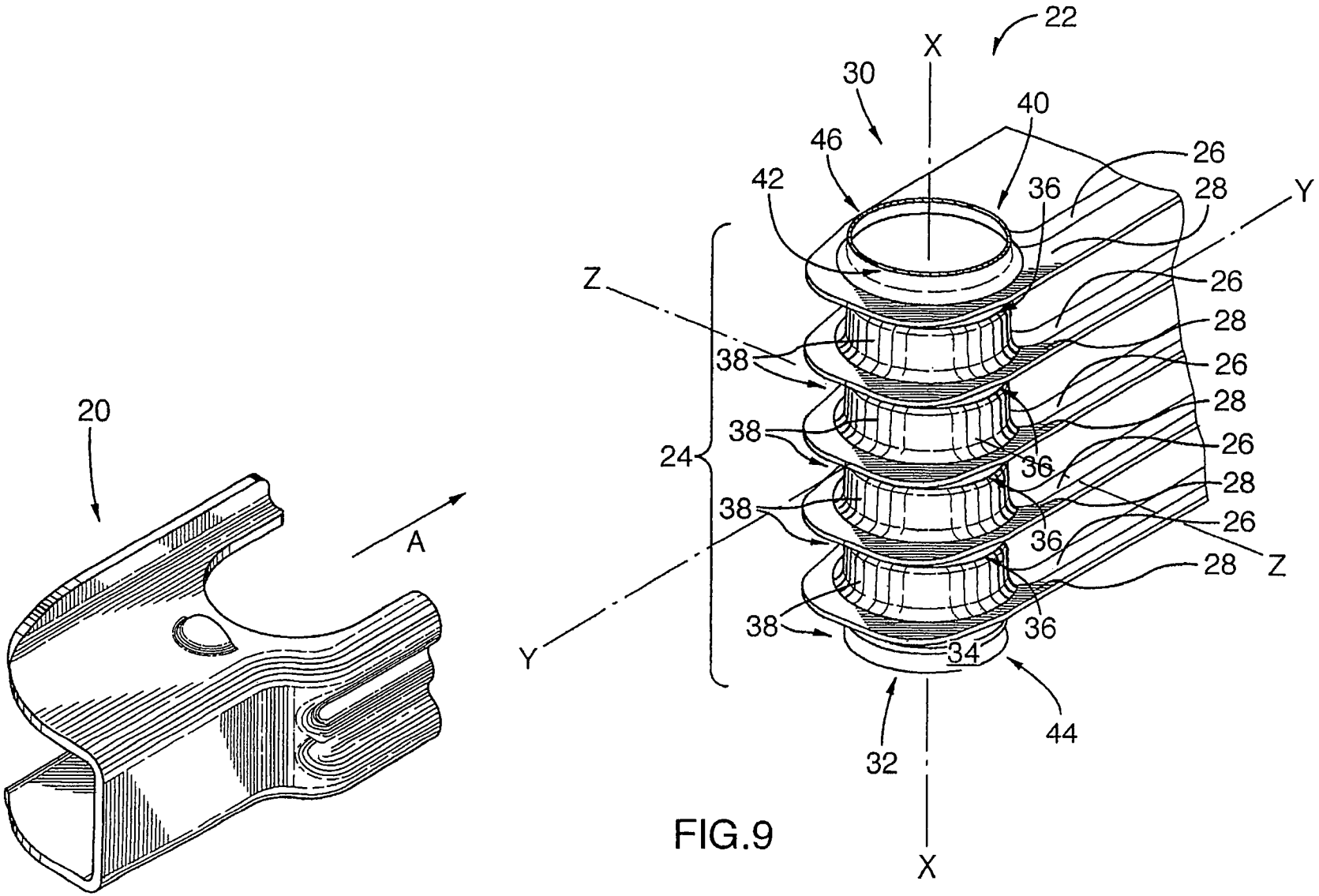
FIG. 9 is a perspective view of the mounting bracket of FIG. 1, shown at a position laterally outwardly from a heat exchanger core, only a portion of which is shown.
Figure 10:
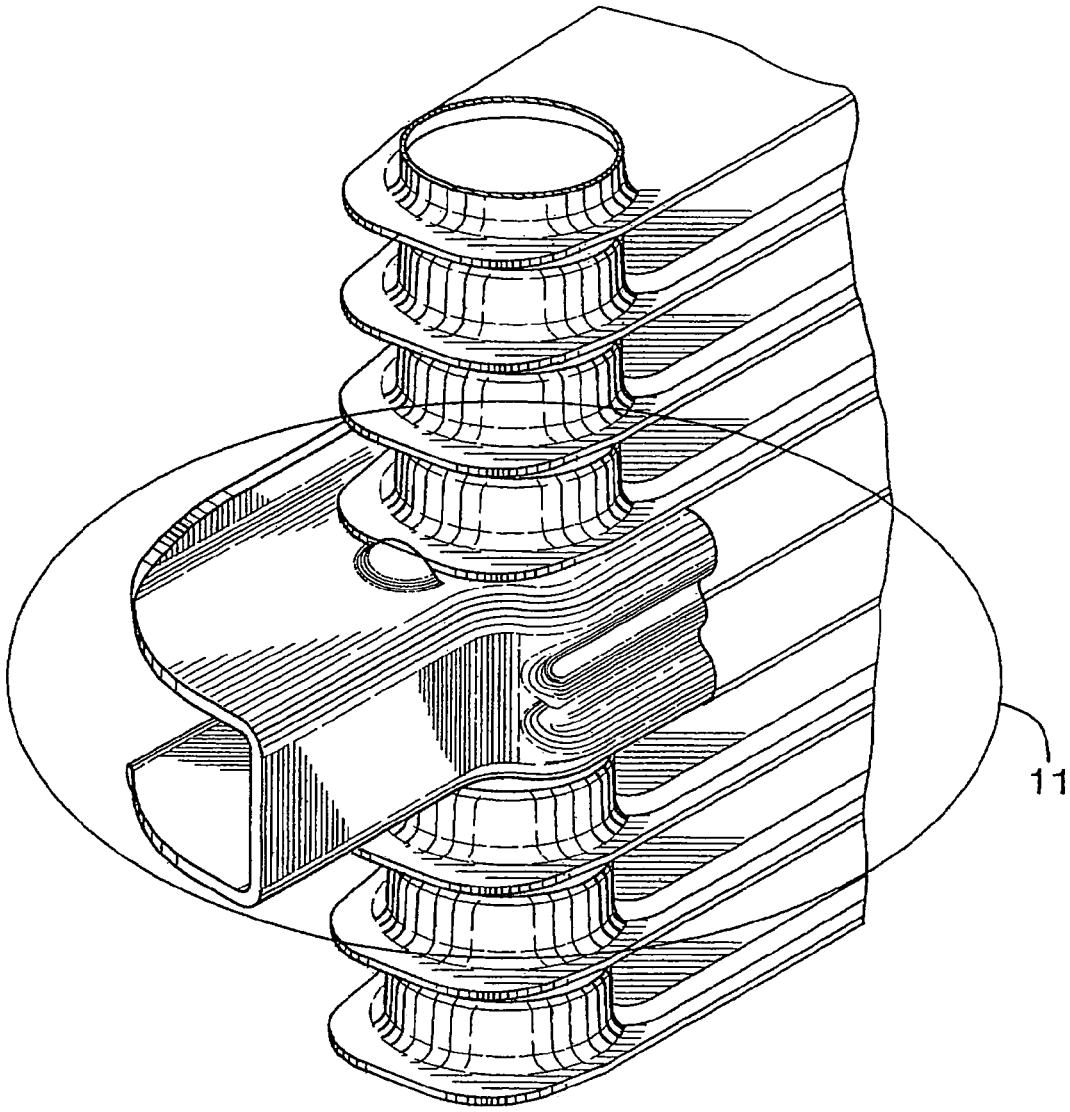
FIG. 10 is a view similar to FIG. 9, with the mounting bracket shown assembled on the heat exchanger core.
Figure 11:
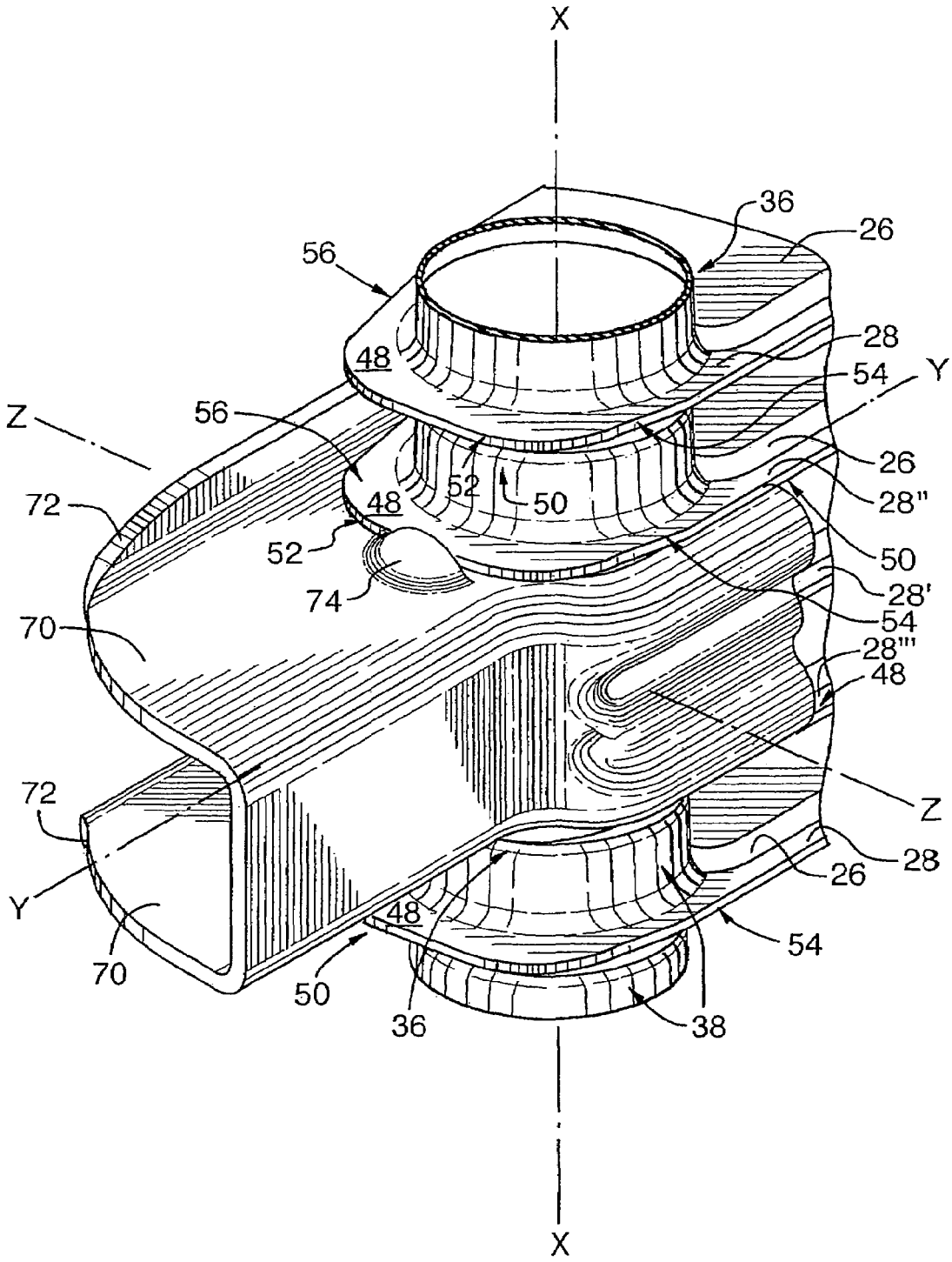
FIG. 11 is an enlarged view of encircled area 11 in FIG. 10.

With general reference to FIGS. 9-11, each flange 28 extends radially, with respect to the primary axis X-X, from its respective manifold segment 38. Further, each flange 28 at least partially surrounds its manifold segment 38. Each flange 28 has a top surface 48 and a bottom surface 50 and is circumscribed by an outer edge portion 52, disposed laterally outwardly from the manifold 24, and by a pair of laterally-extending front and back edge portions 54, 56 spaced-apart from one another in the direction of the tertiary axis Z-Z.

Against this background, the mounting bracket 20 of the preferred embodiment will now be described and should be understood to comprise a clip portion 58 (see FIG. 8) and a mounting panel or lug portion 60.

The clip portion 58 is corrugated to form three elongate, parallel furrows or grooves 62,64,66 best seen in FIG. 3. The innermost 64 of these grooves 62,64,66 defines an elongate groove or furrow 64 which is adapted to mechanically engage a flange front edge portion 54.

The mounting panel portion 60 is rigidly connected to the clip portion 58 in a manner such that clip portion 58 and panel portion 60 together define an elongate bridge structure 68 having opposite ends 68A,68B. The elongate groove 64 runs longitudinally relative to the bridge structure 68, and terminates at the end 68B defined by the clip portion 58.

The mounting bracket 20 further comprises a pair of legs 70, each having a transverse flange 72 along one edge thereof. Flanges 72 extend away from one another in substantially coplanar relation and define bearing portions which are rigidly connected to the bridge structure 68 by the legs 70. More specifically, the legs 70 each rigidly extend between the bridge structure 68 and a respective transverse flange 72. The legs 70 will be seen to be substantially planar, disposed in spaced-apart, substantially parallel relation to one another, to extend substantially the length of the bridge structure 68, and to have respective bifurcated ends 70A which straddle manifold 24. Ends 70A also form contacting portions.

Also provided is a pair of optional abutment ear portions 74, extending away from another, each from a respective leg 70 and in substantially transverse relation thereto.

In the preferred embodiment, the mounting bracket 20 is intended to be permanently connected to the heat exchanger core 22 by brazing or soldering or any other type of joining process. As such, bracket 20 is constructed out of a suitable brazing material, specifically, brazing clad aluminum, suitably stamped and formed into shape, so that engaging and overlapping parts on the mounting bracket 20 and heat exchanger core 22 will be brazed together, preferably simultaneously when the heat exchanger core 22 is being brazed in a furnace brazing process. The composition of brazing clad aluminum, and the manner in which the various structural features of the mounting bracket 20 of the preferred embodiment may be formed are well known to persons of ordinary skill in the art, and as such, not detailed herein.

In use, the mounting bracket 20 is positioned against the heat exchanger core 22 at an assembly position, shown in FIG. 10 through FIG. 15, by positioning the bracket 20 laterally outwardly from the core 22, as shown in FIG. 9, and urging same in the direction of arrow A thereof.

Figure 12:
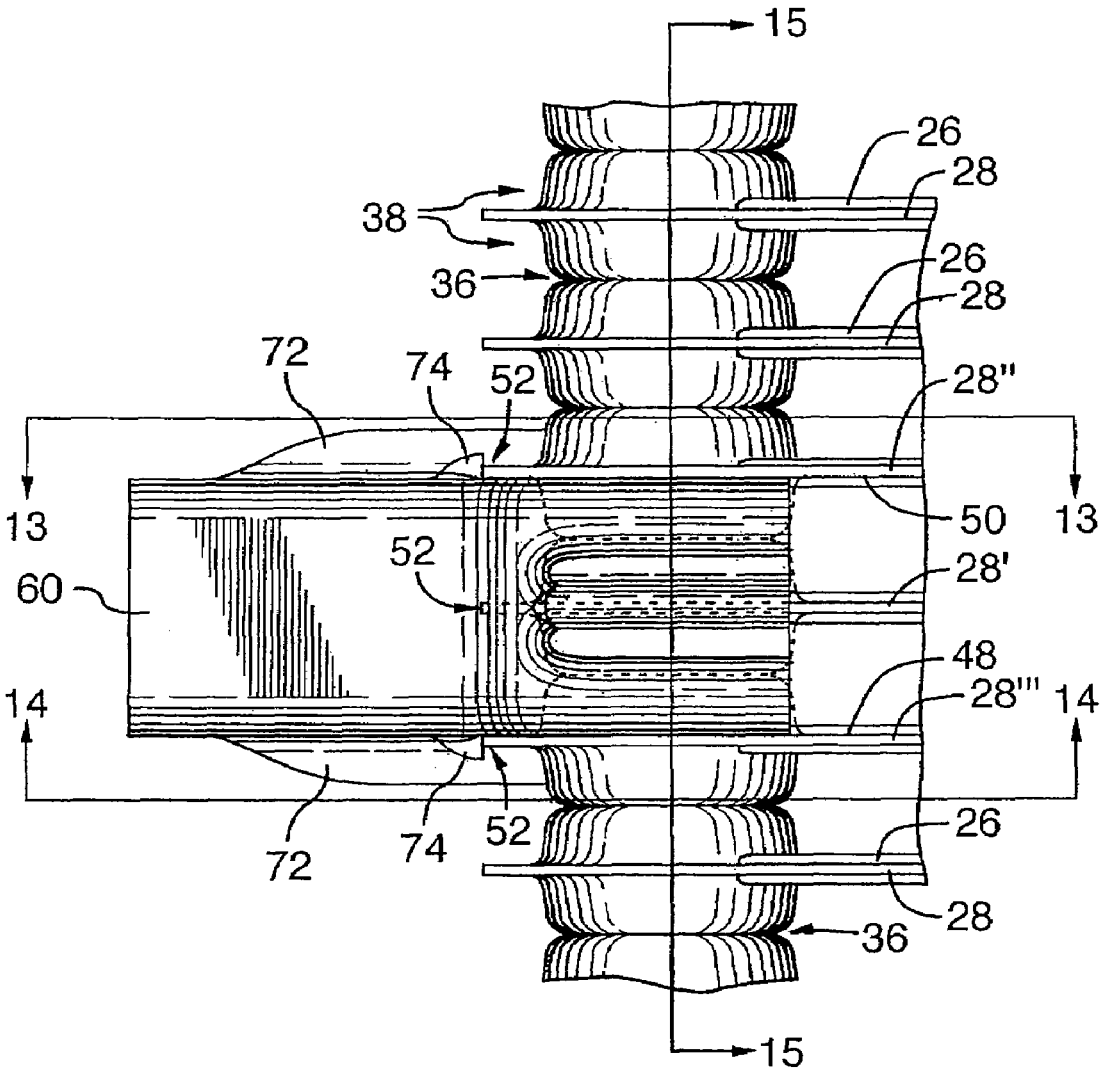
FIG. 12 is a front elevational view of the structure of FIG. 11.
Figure 13:
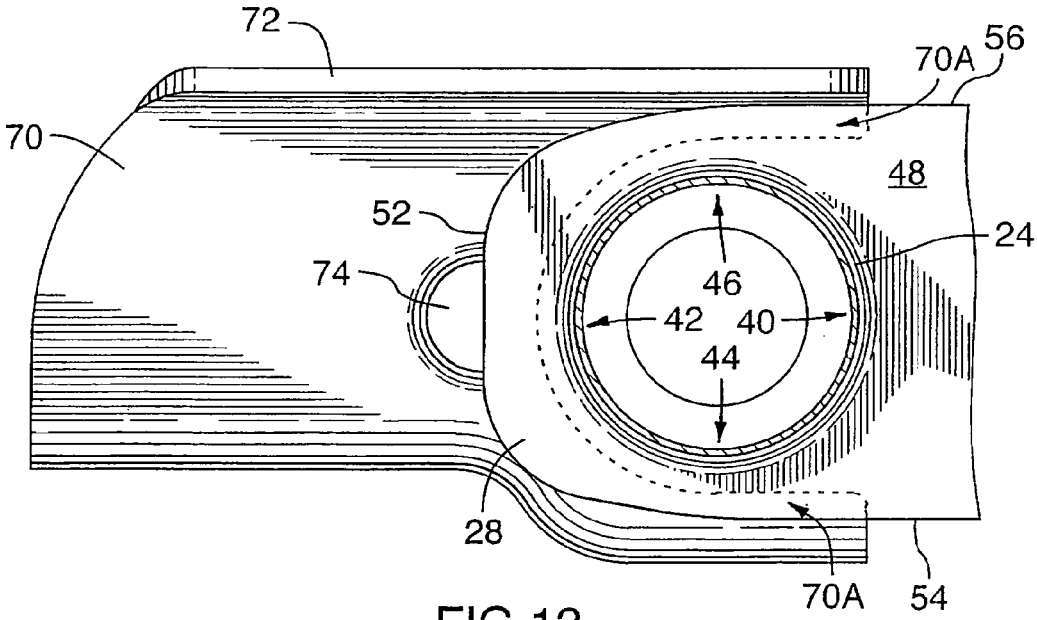
FIG. 13 is a view taken along section lines 13-13 of FIG. 12.
Figure 14:
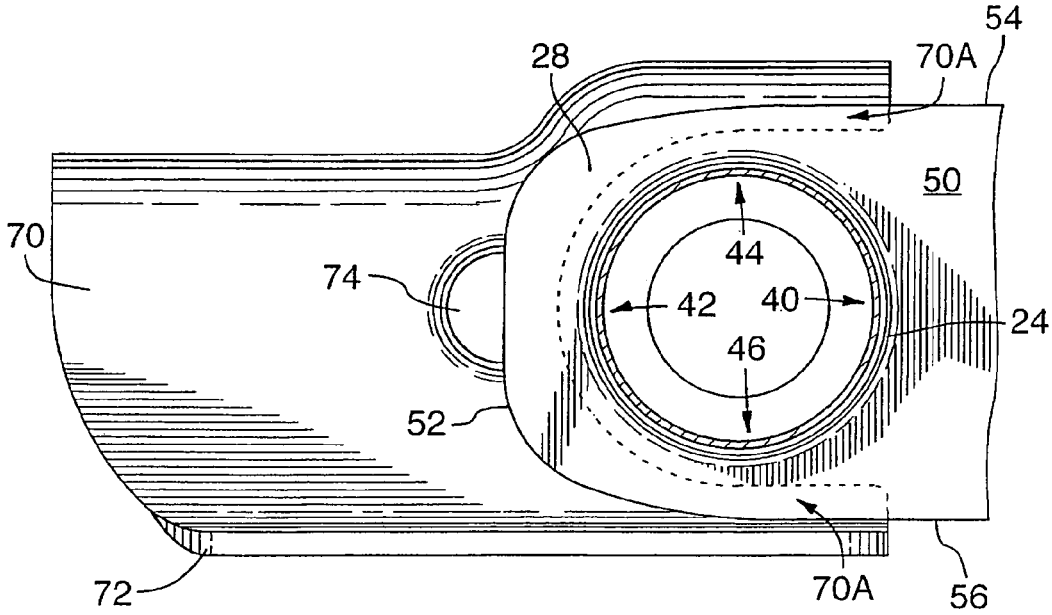
FIG. 14 is a view taken along section lines 14-14 of FIG. 12.
Figure 15:
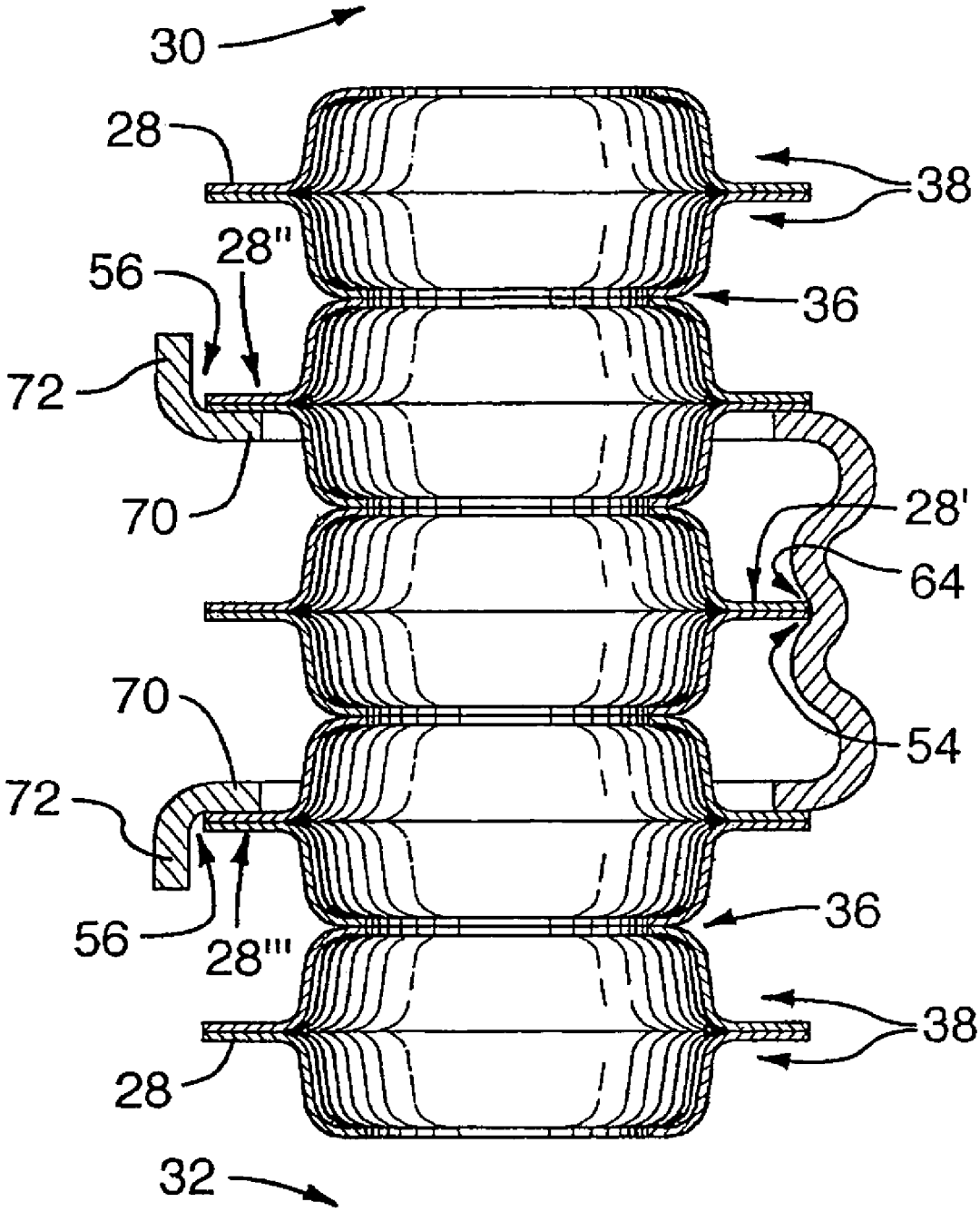
FIG. 15 is a view taken along section lines 15-15 of FIG. 12.

At the assembly position of the mounting bracket 20, as seen in FIG. 11, the front edge portion 54 of a selected flange 28' is mechanically engaged by the elongate groove 64, as illustrated in FIG. 15. One bearing portion or transverse flange 72 engages against the back edge portion 56 of an other adjacent flange 28" disposed, with respect to the selected flange 28', above or relatively proximal to the top end 30 of the manifold 24. The other bearing portion or transverse flange 72 engages against the back edge portion 56 of a further flange 28'" disposed, with respect to the selected flange 28', below or relatively remote or distal to the top end 30 of the manifold 24, as seen best in FIG. 15. Contacting portions 70A are disposed, in overlapping relation, respectively, against the bottom surface 50 of the other flange 28" and against the top surface 48 of the further flange 28'", and straddle the manifold 24 on its front 44, back 46 and outer 42 sides. As indicated in FIGS. 13 and 14, the overlap of contacting portions 70A with flange 28 is delineated in chain-dotted lines. The abutment ear portions 74 engage respectively, the outer edges 52 of the other flange 28" and the further flange 28'", as indicated in FIGS. 11,12. As well, the mounting panel portion 60 projects laterally beyond the outer edge 52 of the selected flange 28', as indicated in FIG. 12, wherein the selected flange 28' is shown in chain-dotted outline.

In such assembly position, the mounting bracket 20 grippingly engages the core 22 with sufficient tenacity so as to permit subsequent permanent connection therebetween by conventional techniques such as brazing, soldering, welding, adhesives or the like, without the need for auxiliary clamps.

This is advantageous, since auxiliary clamps can add to cost and, in the context of brazing, can absorb heat, resulting in poor quality brazed joints. The mounting bracket of the present invention is self-fixturing with respect to the core.

While but a single, preferred embodiment of the mounting bracket of the present invention has been herein described, it will be evident that various modifications and alterations can be made.

For example, whereas in the preferred embodiment illustrated, the mounting bracket engages the flanges of three contiguous manifold segments, to wit, the selected flange 28', the other flange 28" which is longitudinally adjacent to the selected flange 28' and the further flange 28'" which is longitudinally adjacent to the selected flange 28', the mounting bracket could span more or fewer flanges, if desired (not shown). Grooves 62 and 66 could be used to engage two adjacent flanges 28. Further, mounting bracket 20 could be made a bit wider or taller than shown, so that contacting portions 70A engage the top and bottom surfaces of the respective flanges 28" and 28'", or both bottom surfaces or both top surfaces.

Transverse flanges 72 could also extend toward each other with the legs 70 resting above and below flanges 28" and 28'". Ear portions 74 would then extend toward each other as well.

As well, whereas in the preferred embodiment the clip portion is corrugated to form three parallel grooves, it will be readily understood that such construction is not necessary; any other types of protrusion or flanges could be used to define the equivalent of grooves or furrows. A greater or lesser number of furrows could be utilized and indeed, corrugations could be eliminated altogether. The elongate groove, for example, could be machined from a blank.

Moreover, whereas the preferred mounting bracket is constructed out of brazing clad aluminum, for reasons outlined previously, it will of course be evident that other metals or materials may be readily substituted therefor, and the invention is considered to encompass mounting brackets constructed from other materials and methods of joining the components thereof.

Additionally, whereas the mounting bracket of the preferred embodiment includes a discrete mounting panel or lug portion, same is not necessary.

While the preferred embodiment shows a plate pair type heat exchanger core, the mounting bracket of the present invention could be used with heat exchanger cores having pipe manifolds and heat transfer tubes having peripheral edges or flanges adjacent to the front and back sides of the manifolds, or that surround the manifolds. The manifolds could be continuous or be formed in segments, the latter term being used herein to include any type of manifold having discrete areas near the tubes where the mounting bracket is attachable.

Further, whereas in the illustrations, clearance is shown between the fluid tubes, it will be evident that the mounting bracket may be utilized with heat exchangers having fins or vanes disposed between the tubes, or no spaces between the tubes at all.

The terms "tube" or "tubular" in the present specification are intended to include any configuration of hollow conduit, such as conduits having rectangular or hexagonal cross-sections, for example.

As well, whereas the abutment ear portions in the preferred embodiment engage against the flange outer ends in use, they could readily be omitted, and if desired, the positioning functionality thereof could be easily assumed by the bifurcated ends of the legs, by appropriate modifications thereto such that, in use, they straddled the manifold in close-fitting relation.

Of course, the mounting bracket may be utilized with heat exchangers having turbulizers, of expanded metal or the like, disposed within the fluid tubes.

As well, the mounting panel portion 60 could be formed with an aperture shaped and dimensioned to receive a suitable mechanical fastener such as a nut and bolt assembly or rivet (not shown), to mount the heat exchanger core. Further, whereas the mounting panel portion illustrated is substantially planar, and orientated substantially normal to the tertiary axis in use, it could be orientated in any other direction, even perpendicular to the tubes sides (i.e. normal to the secondary axis) if desired, to suit a particular mounting configuration for the core.

Yet further, whereas the disclosure is directed primarily to the field of heat exchangers, the mounting bracket of the present invention may be used in association with other fluid handling devices of similar construction, for example, condensers, filtration devices, fuel cells and fuel reformers or processors.

Additionally, whereas the longitudinal axis defines a manifold top and bottom end which, in the preferred embodiment illustrated, are spaced-apart from one another vertically, it will be evident that the manifold "top" need not be disposed upwardly from the manifold "bottom" and could, for example, be disposed horizontally therefrom, or even downwardly therefrom.

From the foregoing, it will be evident to persons of ordinary skill in the art that the scope of the present invention is limited only by the accompanying claims, purposively construed.

The invention claimed is:

1. A mounting bracket for use with a heat exchanger core of the type having a manifold disposed about a primary axis, said manifold being formed of a plurality of tubular manifold segments and having top and bottom ends spaced apart in the direction of the primary axis, inner and outer sides laterally spaced apart in the direction of a secondary axis perpendicular to the primary axis, and front and back sides spaced apart in the direction of a tertiary axis perpendicular to the primary and secondary axes; a plurality of fluid tubes arranged in substantially parallel relation, each tube extending from a respective manifold segment inwardly and substantially parallel to the secondary axis; and, for each tube, a respective peripheral flange with laterally-extending front and back edge portions adjacent to the respective front and back sides of each respective manifold segment and spaced-apart from one another in the direction of the tertiary axis;

said mounting bracket comprising:

a clip portion having an elongate groove formed therein which engages the front edge portion only of a selected one of the peripheral flanges in use;

a mounting panel portion located adjacent to the clip portion;

a pair of spaced-apart legs extending, in use, transversely to the primary axis from opposite edges of the mounting panel portion in the direction of said tertiary axis to straddle the manifold; and for each leg, a bearing portion positioned such that, when the selected flange is engaged by the elongate groove, the bearing portions engage, respectively, the back edge portion of an other one of the peripheral flanges disposed above the selected flange, and against the back edge portion of a further one of the peripheral flanges disposed below the selected flange, thereby to grip the core.

2. The mounting bracket according to claim 1, wherein the other flange is immediately adjacent to the selected flange.

3. The mounting bracket according to claim 1 wherein the clip portion is corrugated to form three elongate, parallel furrows, the innermost of said furrows defining the elongate groove.

4. The mounting bracket according to claim 2 wherein the clip portion is corrugated to form three elongate, parallel furrows, the innermost of said furrows defining the elongate groove.

5. The mounting bracket according to claim 1 wherein the mounting panel portion is rigidly connected to the clip portion and adapted to be secured to a vehicle frame.

6. The mounting bracket according to claim 5 wherein the mounting panel portion is rigidly connected to the clip portion and, in use, is perpendicular to the tertiary axis.

7. The mounting bracket according to claim 5 wherein the mounting panel portion projects laterally beyond the outer edge of the selected flange in use.

8. The mounting bracket according to claim 5 wherein the clip portion and the mounting panel portion together define an elongate bridge structure, with each defining one end of the bridge structure, and wherein the elongate groove runs longitudinally relative to the bridge structure and terminates at the end defined by the clip portion.

9. The mounting bracket according to claim 8 wherein the pair of legs are connected to the bridge structure.

10. The mounting bracket according to claim 9 wherein the legs are substantially planar, are orientated substantially parallel to one another, and have contacting portions which are disposed in overlapping relation, respectively, against the bottom surface of said other flange and against the top surface of said further flange in use.

11. A mounting bracket for use with a heat exchanger core of the type having a manifold disposed about a primary axis, said manifold being formed of a plurality of tubular manifold segments and having top and bottom ends spaced apart in the direction of the primary axis, inner and outer sides laterally spaced apart in the direction of a secondary axis perpendicular to the primary axis, and front and back sides spaced apart in the direction of a tertiary axis perpendicular to the primary and secondary axes; a plurality of fluid tubes arranged in substantially parallel relation, each tube extending from a respective manifold segment, inwardly and substantially parallel to the secondary axis; and, for each tube, a respective peripheral flange with laterally extending front and back edge portions adjacent to the respective front and back sides of each respective manifold segment and spaced-apart from one another in the direction of the tertiary axis;

said mounting bracket comprising:

a corrugated clip portion having three elongate, parallel furrows, the innermost of said furrows defining an elongate groove which engages the front edge portion of a selected one of the peripheral flanges in use;

a pair of bearing portions rigidly connected to the clip portion and positioned relative thereto such that, when the selected flange is engaged by the elongate groove, the bearing portions engage, respectively, the back edge portion of an other one of the peripheral flanges disposed above the selected flange, and against the back edge portion of a further one of the peripheral flanges disposed below the selected flange, thereby to grip the core in combination with the clip portion;

a mounting panel portion rigidly connected to the clip portion and adapted to be secured to a vehicle frame;

the clip portion and the panel portion together defining an elongate bridge structure, with each defining one end of the bridge structure, the elongate groove running longitudinally relative to the bridge structure and terminating at the end defined by the clip portion;

a pair of legs disposed, in use, transversely of the primary axis in spaced-apart relation to one another and connected to opposite edges of the bridge structure, the legs having contacting portions overlapping said other and further ones of the peripheral flanges in use, the legs each having a respective one of the pair of bearing portions; and the legs extending generally the length of the bridge structure, the contacting portions being defined by bifurcated ends of the legs, contiguous with the clip portion, which, in use, straddle the manifold on its front, back and outer sides.

12. The mounting bracket according to claim 9 wherein each bearing portion comprises a transverse flange formed along an edge of its respective leg, said flanges extending away from one another and being in substantially coplanar relation to each other.

13. The mounting bracket according to claim 9 and further comprising a pair of abutment ear portions each associated with a respective one of the legs, said pair of abutment ear portions extending transversely to the legs, and engaging, in use, respectively, the other flange and said further flange.

14. The mounting bracket according claim 13 wherein the abutment ear portions extend away from one another.

15. A heat exchanger comprising:

a heat exchanger core having a manifold disposed about a primary axis, said manifold being formed of a plurality of tubular manifold segments and having top and bottom ends spaced apart in the direction of the primary axis, inner and outer sides laterally spaced apart in the direction of a secondary axis perpendicular to the primary axis, and front and back sides spaced apart in the direction of a tertiary axis perpendicular to the primary and secondary axes;

a plurality of fluid tubes arranged in substantially parallel relation, each tube extending from a respective manifold segment, inwardly and substantially parallel to the secondary axis; and for each tube, a respective peripheral flange with front and back edge portions adjacent to the respective front and back sides of each respective manifold segment and spaced-apart from one another in the direction of the tertiary axis;

a mounting bracket comprising:

a corrugated clip portion having three elongate, parallel furrows, the innermost of said furrows defining an elongate groove which engages the front edge portion of a selected one of the peripheral flanges;

a pair of bearing portions rigidly connected to the clip portion and positioned relative thereto to engage, respectively, the back edge portion of an other one of the peripheral flanges disposed above the selected flange, and against the back edge portion of a further one of the peripheral flanges disposed below the selected flange, thereby to grip the core in combination with the clip portion;

a mounting panel portion rigidly connected to the clip portion and adapted to be secured to a vehicle frame;

the clip portion and the mounting panel portion together defining an elongate bridge structure, with each defining one end of the bridge structure, the elongate groove running longitudinally relative to the bridge structure and terminating at the end defined by the clip portion;

a pair of legs disposed in spaced-apart relation to one another and connected to opposite edges of the bridge structure, the legs each having a respective one of the pair of bearing portions;

the legs being substantially planar, orientated transversely to the primary axis, substantially parallel to one another, and having contacting portions which are disposed in overlapping relation, respectively, against the bottom surface of said other one of the peripheral flanges and against the top surface of said further one of the peripheral flanges; and the legs extending generally the length of the bridge structure, the contacting portions being defined by bifurcated ends of the legs, contiguous with the clip portion, to straddle the manifold on its front, back and outer sides.

16. The mounting bracket according to claim 10 wherein each bearing portion comprises a transverse flange formed along an edge of its respective leg, said flanges extending transversely to the contacting portions.

17. The mounting bracket according to claim 6 wherein the mounting panel portion projects laterally beyond the outer edge of the selected flange in use.

18. The mounting bracket according to claim 1 wherein the legs are substantially planar, are orientated substantially parallel to one another, and have contacting portions which, in use, are disposed in overlapping relation, respectively, against the bottom surface of said other flange and against the top surface of said further flange.

19. The mounting bracket according claim 10 wherein the legs extend generally the length of the clip portion and wherein the contacting portions are defined by bifurcated ends of the legs, contiguous with the clip portion, which, in use, straddle the manifold on its front, back and outer sides.

20. The heat exchanger according to claim 15, wherein the core is formed of stacked plate pairs, each plate pair defining a tube and the interfacing portions of the plates in each plate pair defining the respective peripheral flanges.

* * * * *